US008800080B2

(12) United States Patent
Kay et al.

(10) Patent No.: US 8,800,080 B2
(45) Date of Patent: Aug. 12, 2014

(54) LONG TERM CARE BED

(75) Inventors: Norman A. Kay, London (CA); Andrew Peter Johnson, London (CA); Daniel DeSousa, London (CA)

(73) Assignee: Drive Medical Design & Mfg., Port Washington, NY (US)

( * ) Notice: Subject to any disclaimer, the term of this patent is extended or adjusted under 35 U.S.C. 154(b) by 25 days.

(21) Appl. No.: 13/223,507

(22) Filed: Sep. 1, 2011

(65) Prior Publication Data

US 2013/0055502 A1 Mar. 7, 2013

(51) Int. Cl.
*A47B 7/02* (2006.01)

(52) U.S. Cl.
USPC ..... 5/618; 5/611; 5/613; 5/616

(58) Field of Classification Search
USPC ..... 5/611, 613, 616, 618
See application file for complete search history.

(56) References Cited

U.S. PATENT DOCUMENTS 4,104,749 A * 8/1978 Grundler ..... 5/616
4,425,673 A 1/1984 Werner
4,472,845 A 9/1984 Chivetta et al.
4,679,261 A * 7/1987 Stanley et al. ..... 5/183
4,921,295 A 5/1990 Stollenwerk
5,105,486 A 4/1992 Peterson
5,148,562 A 9/1992 Borders et al.
5,461,740 A 10/1995 Pearson
5,570,485 A 11/1996 Kurlander et al.
5,594,961 A 1/1997 Yokoi et al.
6,209,157 B1 4/2001 Hensley
6,357,065 B1 3/2002 Adams
6,405,393 B2 6/2002 Megown
6,473,922 B1 11/2002 Sommerfeld et al.
6,520,460 B2 * 2/2003 Hallberg et al. ..... 248/188.5
6,578,216 B1 6/2003 Aarestad
6,601,251 B2 8/2003 Paul
6,601,271 B1 8/2003 Sommerfeld et al.
6,643,873 B2 11/2003 Heimbrock et al.
6,851,144 B2 2/2005 Wang
6,868,567 B2 * 3/2005 Edgerton ..... 5/611
6,880,202 B2 4/2005 Thompson et al.
6,941,600 B2 9/2005 Freeborn et al.
7,003,828 B2 * 2/2006 Roussy ..... 5/611
7,013,510 B1 * 3/2006 Johnson ..... 5/611

(Continued)

OTHER PUBLICATIONS

Partial European Search Report EP 12 00 6155 dated Jan. 21, 2014.

*Primary Examiner* — Robert G Santos
*Assistant Examiner* — Richard G Davis
(74) *Attorney, Agent, or Firm* — Carter DeLuca Farrell & Schmidt LLP

(57) ABSTRACT

An adjustable bed system includes a first frame having four actuators coupled thereto and disposed between the head and foot ends thereof. The actuators define a generally-rectangular configuration wherein first and third actuators are diagonally-opposed and wherein second and fourth actuators are diagonally-opposed. A second frame coupled to the first frame includes a first section secured to the first frame, a second section pivotably coupled to the first section towards the head end of the first frame, and a third section pivotably coupled to the first section towards the foot end of the first frame. The first and third actuators arc coupled to the second and third sections, respectively, for articulating the second and third sections, respectively. First and second leg assemblies are coupled to the second and fourth actuators, respectively, for selectively raising and lowering the first frame.

10 Claims, 7 Drawing Sheets

(56) References Cited

U.S. PATENT DOCUMENTS

| | | | | |
|---|---|---|---|---|
| 7,055,195 | B2 * | 6/2006 | Roussy | 5/616 |
| 7,134,155 | B2 | 11/2006 | Freeborn et al. | |
| 7,185,377 | B2 | 3/2007 | Roussy | |
| 7,237,289 | B2 | 7/2007 | Lowenthal | |
| 7,334,277 | B2 * | 2/2008 | Johnson | 5/611 |
| 7,509,697 | B2 * | 3/2009 | Dorenbeck | 5/611 |
| 7,596,820 | B2 | 10/2009 | Nielsen et al. | |
| 7,631,379 | B2 | 12/2009 | Lindner | |
| 7,703,157 | B2 * | 4/2010 | Dorenbeck | 5/611 |
| 8,191,940 | B2 * | 6/2012 | Bly et al. | 292/163 |
| 2002/0059679 | A1 | 5/2002 | Weismiller et al. | |
| 2005/0210588 | A1 * | 9/2005 | Loewenthal | 5/618 |
| 2005/0283911 | A1 * | 12/2005 | Roussy | 5/611 |
| 2005/0283914 | A1 * | 12/2005 | Roussy | 5/616 |
| 2008/0040857 | A1 * | 2/2008 | Karmer et al. | 5/616 |
| 2008/0127418 | A1 * | 6/2008 | Rawls-Meehan | 5/613 |
| 2008/0127419 | A1 * | 6/2008 | Jensen | 5/616 |
| 2008/0208709 | A1 * | 8/2008 | Craver | 705/27 |
| 2009/0064414 | A1 * | 3/2009 | Andersen et al. | 5/611 |
| 2011/0138536 | A1 * | 6/2011 | Wernqvist et al. | 5/618 |
| 2011/0162145 | A1 * | 7/2011 | Osborne et al. | 5/618 |

* cited by examiner

LONG TERM CARE BED

BACKGROUND

1. Technical Field

The present disclosure relates to long term care beds, and more particularly, to height-adjustable and articulatable bed systems.

2. Background of Related Art

Adjustable beds are often used in both home care and in more formalized medical settings, e.g., hospital rooms. Adjustable beds generally include a bed frame configured to support a mattress thereon, leg assemblies for supporting the bed frame, and one or more mechanisms for adjusting the height of the bed frame relative to the floor, e.g., to raise/lower the patient and/or for articulating the bed frame, e.g., to position the patient in a lying position, a sitting position, etc.

Adjustable bed systems can be either manually operated or automatic, e.g., motorized. Manual systems are typically operated via a hand crank, whereas automated systems regulate operation via an electric motor. Automated systems often employ one or more actuators that are driven by the electric motor (or motors) to articulate the leg assemblies relative to the frame for raising/lowering the mattress and/or articulate the bed frame to achieve a desired configuration. As can be appreciated, it is desirable that the adjustable bed be height adjustable between at least a lowered position, wherein the mattress is in close proximity to the floor, a raised position wherein the leg assemblies support the mattress in spaced-relation relative to the floor, as well as both the Trendelenburg position and the reverse-Trendelenburg position. With regard to the articulation of the bed frame, it is desirable that the frame be adjustable between at least a flat or lying position, a raised back or seated position, a raised legs position and combinations thereof. Further, it is desirable that the raising and lowering of the bed be accomplished without changing the bed's footprint, i.e., without outwardly expanding the dimensions of the bed in any direction.

SUMMARY

In accordance with one embodiment of the present disclosure, an adjustable bed system is provided. The adjustable bed system includes a first frame defining a head end and a foot end. The first frame includes four actuators coupled thereto and disposed between the head and foot ends thereof. More specifically, the four actuators are arranged to define a generally-rectangular configuration wherein the first and third actuators are diagonally-opposed relative to one another and wherein the second and fourth actuators are diagonally-opposed relative to one another. A second frame is disposed atop and coupled to the first frame. The second frame includes a plurality of sections. In particular, the second frame includes a first section secured to the first frame and positioned between the head and foot ends thereof, a second section pivotably coupled to the first section and positioned towards the head end of the first frame, and a third section pivotably coupled to the first section and positioned towards the foot end of the first frame. The first actuator is operably coupled to the second section for selectively articulating the second section relative to the first frame, while the third actuator is operably coupled to third section for selectively articulating the third section relative to the first frame. First and second leg assemblies configured to support the frames are disposed towards the head and foot ends, respectively, of the first frame. The second actuator is operable coupled to the first leg assembly for selectively raising and lowering the head end of the first frame, while the fourth actuator is operable coupled to the second leg assembly for selectively raising and lowering the foot end of the first frame.

In one embodiment, the second frame includes a fourth section that is pivotally coupled to the third section towards the foot end of the first frame.

In another embodiment, the sections of the second frame are releasably couplable to one another. Specifically, each section of the second frame may include one or more female clevis members extending therefrom that are configured to each receive a clevis pin therethrough for pivotably coupling the sections to one another.

In another embodiment, each section of the second frame includes a first longitudinal side and a second longitudinal side, at least one of which is telescopically extendable to extend a width of the section. The width of the second frame may be extendable between about 36 inches and about 42 inches.

In yet another embodiment, each of the sections of the second frame includes a first end and a second end. At least one of the first and second ends of one or more of the sections is telescopically extendable to extend a length of the second frame. The length of the second frame may be extendable between about 76 inches and about 86 inches.

In still another embodiment, each of the sections of the second frame includes one or more removable slat coupled thereto and extending between the sides thereof. A clevis pin may be used to releasably couple each of the slats to the respective, section thereof.

In still yet another embodiment, each leg assembly includes a pair of caster assemblies disposed at opposed sides thereof. As can be appreciated, the caster assemblies are rotatable to facilitate translation of the adjustable bed system. In such embodiment, a locking mechanism coupled to one or both of the pairs of rotating caster assemblies may be provided. The locking mechanism is transitionable from an unlocked state to a locked state to inhibit translation of the adjustable bed system.

In another embodiment, the locking mechanism includes a lock bar extending between the caster assemblies of the pair. The lock bar includes a pad disposed thereabout t hat is transitionable between a disengaged position and an engaged position for locking and unlocking the locking mechanism. More particularly, in the engaged position, the pad is engaged within a surface, e.g., the floor, to frictionally-inhibit translation of the adjustable bed system.

The locking mechanism may further include a lock lever extending outwardly from either or both of the caster assemblies of the pair. Each lock lever includes a first end and a second end configured such that applying generally-downward pressure at the first end of the lock lever transitions the locking mechanism to the locked state and such that applying generally-downward pressure at the second end of the lock lever transitions the locking mechanism to the unlocked state.

Another embodiment of an adjustable bed system provided in accordance with the present disclosure includes a first frame and a second frame disposed atop and coupled to the first frame. The second frame includes a plurality of sections, at least one of which is pivotable relative to the first frame. First and second leg assemblies support the frames and are each operable to selectively raise and lower the first frame. One or more actuators are coupled to the first frame. The actuator(s) is configured to selectively pivot the section(s) of the second frame relative to the first frame, selectively move the first leg assembly relative to the first frame, and/or selectively move the second leg assembly relative to the first frame. Each actuator includes an arm and a sleeve, The arm is telescopically translatable relative to the sleeve between a retracted position and an extended position and defines a first cross-sectional configuration. An actuator brace for each actuator is coupled to the first frame. Each actuator brace is configured to receive the arm of the actuator therethrough. More specifically, the actuator brace defines a lumen extending longitudinally therethrough to permit reciprocation of the arm therethrough as the arm is translated between the retracted and extended positions. The lumen of the actuator brace defines a second cross-sectional configuration that is complementary to the first cross-sectional configuration of the arm to substantially inhibit off-axis excursions of the arm as the arm is translated between the retracted and extended positions.

In one embodiment, the actuator arm includes one or more flange extending longitudinally therealong. The flanges are configured for receipt within a complementary-shaped recess (or recesses) defined within the inner surface of the actuator brace to inhibit off-axis excursions of the arm as the arm is translated between the retracted and extended positions.

Similar to the previous embodiments, the first frame may include four actuators coupled thereto and/or may otherwise be configured similarly to any of the embodiments discussed above.

An articulating frame for use in an adjustable bed system is also provided in accordance with the present disclosure. The articulating frame is configured to couple to a fixed frame of the adjustable bed system and includes a first section fixedly engaged to the fixed frame that has one or more female clevis member extending from each end thereof. A second section includes one or more female clevis member extending from an end thereof that arc configured for positioning adjacent the female clevis member(s) extending from one end of the first section. A third section including one of more female clevis members extending from an end thereof is configured for positioning adjacent the female clevis member(s) extending-from the other end of the first section. Clevis pins are insertable through the adjacent female clevis members of the first and second sections and of the first and third sections for pivotably engaging the first and second sections and the first and third sections, respectively, to one another. Further, the articulating frame may be configured similarly to the second frame in any of the above embodiments.

BRIEF DESCRIPTION OF THE DRAWINGS

Various embodiments of the presently disclosed adjustable bed system and components thereof are described with reference to the accompanying drawing figures, wherein.

DETAILED DESCRIPTION

Figure 1:
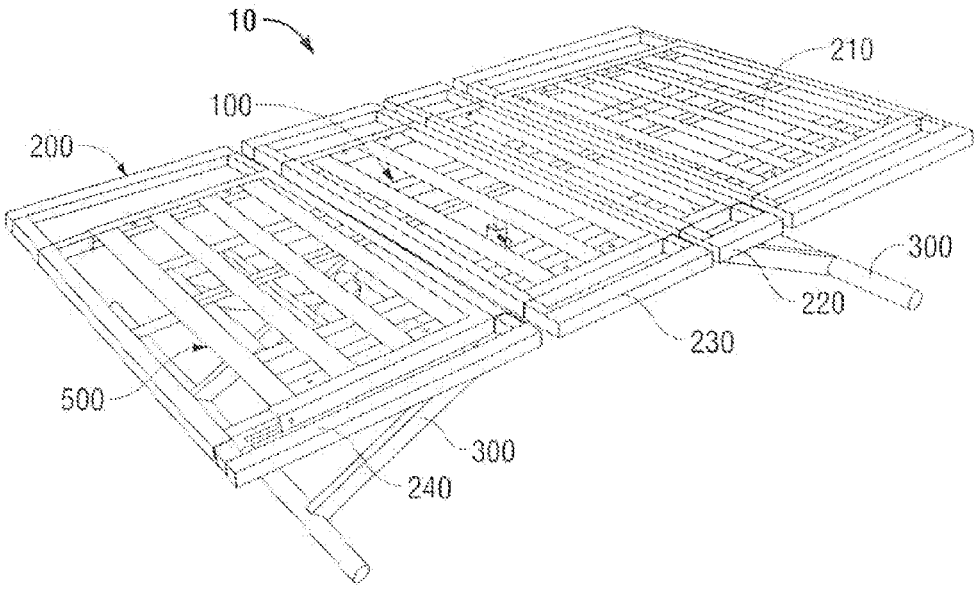
FIG. 1 is a side, perspective view of one embodiment of an adjustable bed provided in accordance with the present disclosure.

Various exemplary embodiments of the presently disclosed subject matter will now be described in detail with reference to the drawings, wherein like references characters identify similar or identical elements.

Turning now to FIGS. 1-5, an adjustable and articulatable bed system provided in accordance with embodiments of the present disclosure is shown generally identified by reference numeral 10. Bed system 10 is particularly suitable for long term care, although bed system 10 may also find application in short term care, and/or may be used in both hospital settings as well as in private home care settings. Bed system 10 generally includes a first, fixed frame 100, a second, articulatable frame 200 articulatably mounted on first frame 100, a pair of leg assemblies 300 coupled to first frame 100 and extending downwardly therefrom, and a plurality of actuators, e.g., four (4) actuators 420, 440, 460, 480, operable to control articulation of second frame 200 relative to first frame 100 and to control adjustment of leg assemblies 300 to raise and lower first frame 100. Bed system 10 may further include a slat assembly 500 coupled to second frame 200 and/or a caster assembly 600 (FIGS. 14-15) including a locking mechanism 700 (FIGS. 14-15) coupled to one or both of leg assemblies 300.

Figure 2:
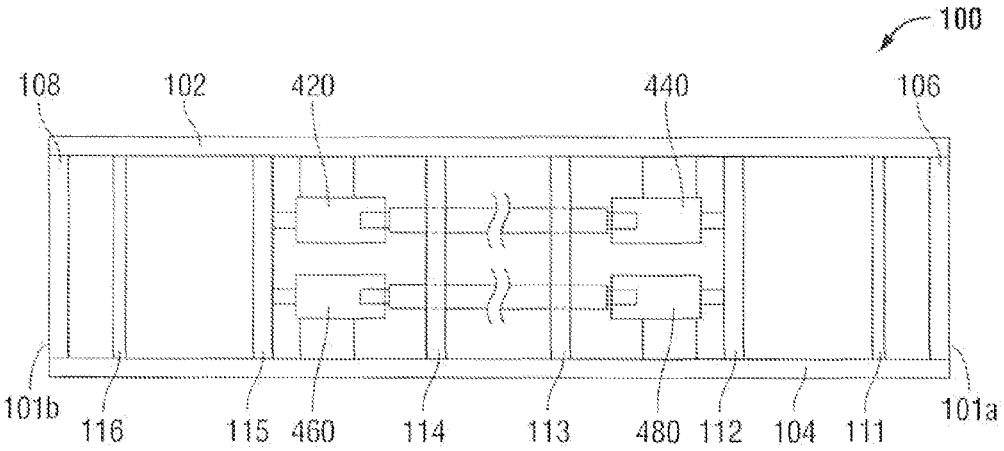
FIG. 2 is a top view of a fixed frame of the adjustable bed of FIG. 1 including a plurality of actuators coupled thereto for articulating the articulatable frame and for adjusting a height of the adjustable bed.

With reference now to FIG. 2, first, fixed frame 100 includes a head end 101 a. a foot end 101*b*, and defines a generally rectangular-shaped configuration formed by a pair of longitudinal side beams 102, 104 and first and second end beams 106, 108, respectively. First frame 100 may further include a plurality of spaced-apart support beams, e.g., six support beams 111, 112, 113, 114, 115, 116 extending between longitudinal side beams 102, 104 in substantially parallel orientation relative to first and second end beams 106, 108, respectively, for providing additional structural support to first frame 100, pivotably securing the sections 210, 220, 230 of second frame 200 thereto and/or for securing actuators 420, 440, 460, 480 thereto, as will be described in greater detail hereinbelow. First frame 100 may further be configured to support head and foot boards (not shown) at the head and foot ends 101*a*, 101, respectively, thereof.

Figure 3:
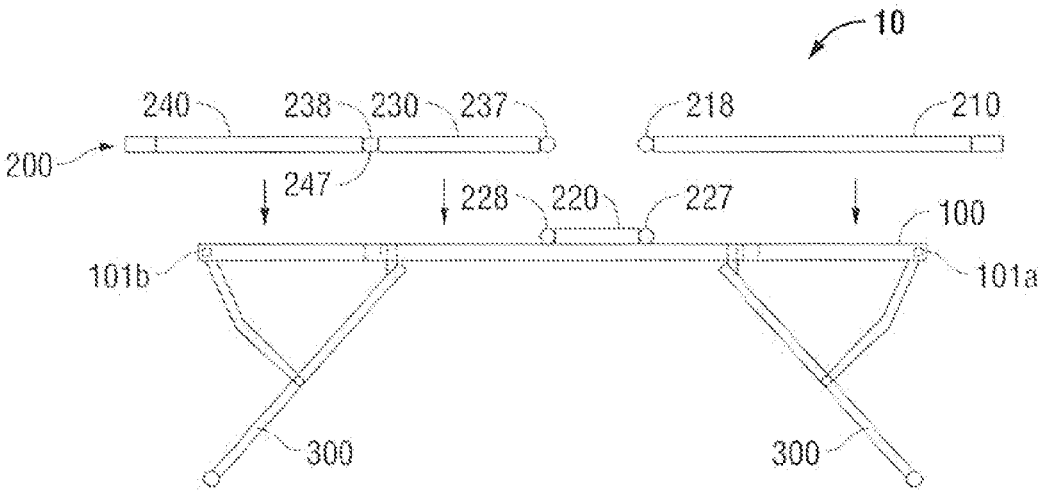
FIG. 3 is a side view of the adjustable bed of FIG. 1 wherein components of an articulatable frame of the adjustable bed of FIG. 1 have been removed from the adjustable bed.
Figure 5:
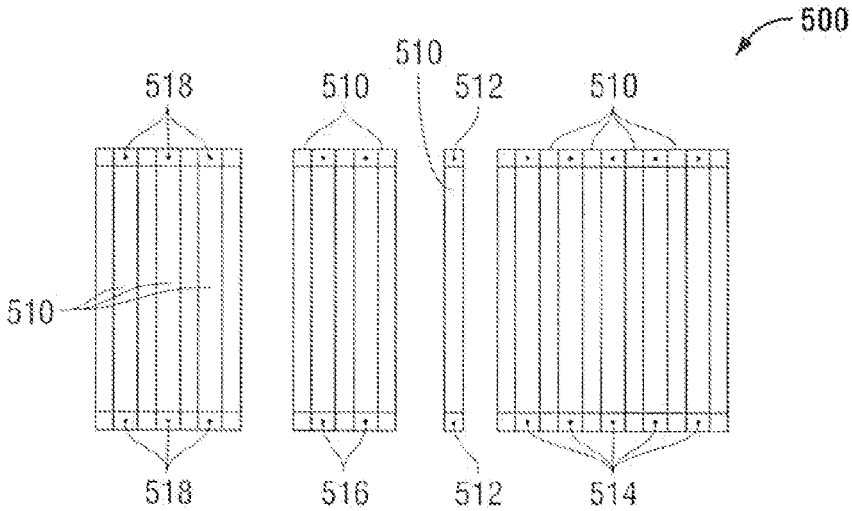
FIG. 5 is a top view of a slat system for use in conjunction with the articulatable frame of FIG. 4.
Figure 4:
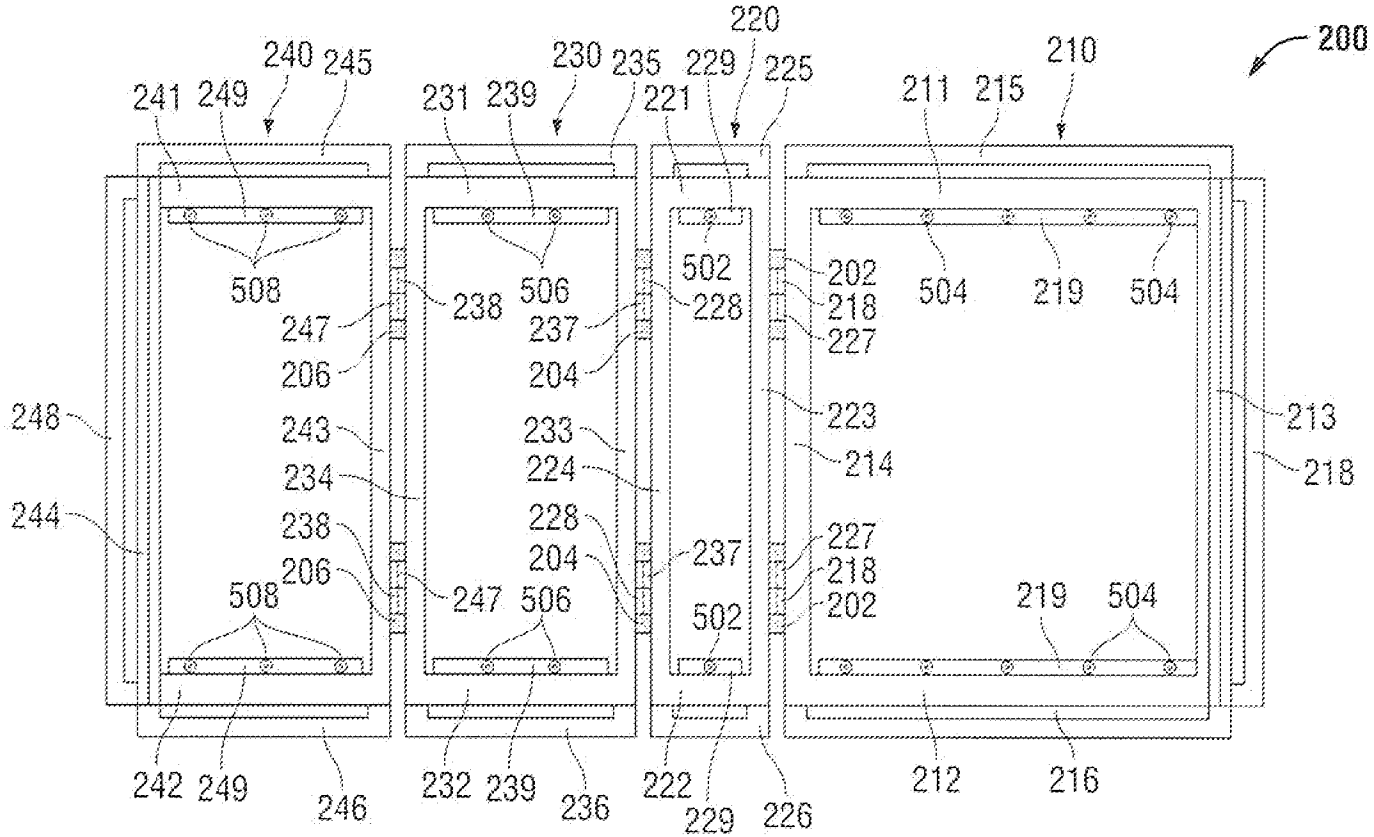
FIG. 4 is a top view of the articulatable frame of the adjustable bed of FIG. 1.
Figure 7:
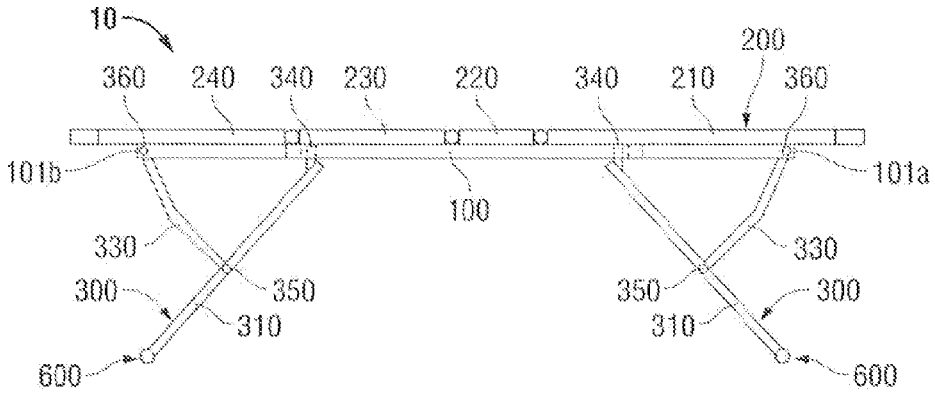
FIG. 7 is a side view of the adjustable bed of FIG. 1 shown in a raised position.
Figure 8:
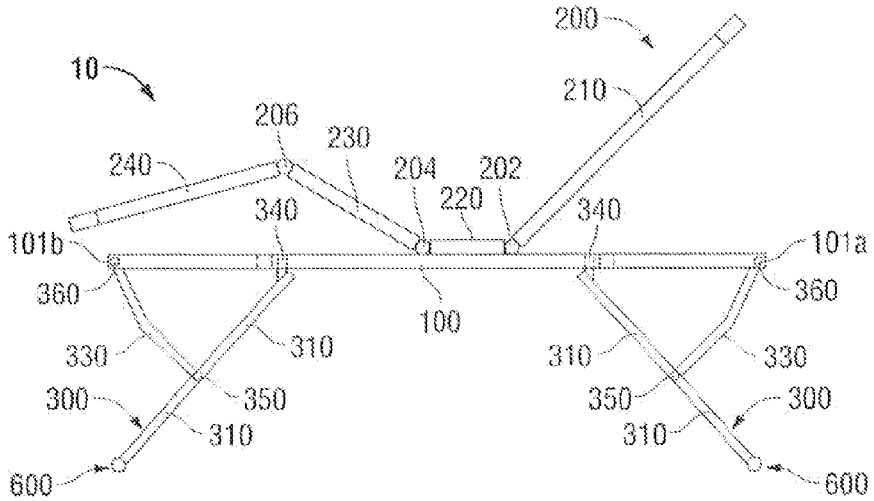
FIG. 8 is a side view if the adjustable bed of FIG. 1 shown in an articulated position.

Referring now to FIGS. 3-5, second, articulatable frame 200 includes a plurality of sections 210, 220, 230, 240 pivotably coupled to one another and moveable relative to one another and first frame 100 (FIG. 2) at least between a substantially linear, or lying configuration (FIG. 7), a seated position (FIG. 11), a legs raised position (FIG. 12), and a seated and legs raised position (FIG. 8). More specifically, second frame 200 includes a back section 210, a hip section 220, a thigh section 230, and a lower leg section 240, although greater or fewer than four (4) sections and/or different configurations of sections 210-240 are also contemplated.

Hip section 220 is fixedly secured to first frame 100 (FIG. 2), e.g., via welding, and defines a generally rectangular, frame-like configuration having first and second sides 221, 222, respectively, and first and second ends 223, 224, respectively. More specifically, hip section 220 is secured to longitudinal side beams 102, 104 (FIG. 2) of first frame 100 (FIG. 2). Each end 223, 224 of hip section 220 includes a pair of spaced-apart female clevis members 227, 228, respectively, i.e., a pair of spaced-apart, elongated cylindrical rings 227, 228, secured thereto, e.g., via welding, and extending therefrom. Each pair of female clevis member 227, 228, in turn, may also be welded to a respective support beam 113, 114 (FIG. 2), of first frame 100 (FIG. 2) to further anchor hip section 220 of second frame 200 in fixed position about first frame 100 (FIG. 2).

Each of the first and second sides 221, 222 of hip section 220 includes a respective lateral extension portion 225, 226 that is telescopically coupled thereto. Lateral extension portions 225, 226 are selectively extendable relative to hip section 220 to vary the width of hip section 220. Clevis pins (not explicitly shown) or other suitable releasable securment mechanisms may be provided for locking lateral extension portions 225, 226 in position relative to hip section 220 and, thus, to fix the width of hip section 220 at discrete locking positions between the fully retracted position, as shown in FIG. 4. and a fully extended position, or for selectively fixing the width of hip section 220 at any position between the retracted and extended positions. Further, it is envisioned that the width of hip section 220 (as well as the Other sections of second frame 200) be extendable from about 36 inches to about 42 inches to accommodate patients of varying sizes, although other ranges are also contemplated.

First and second sides 221, 222 of hip section 220 each further include a shelf 229 extending inwardly therefrom. Shelves 229 each include an aperture 502 defined therethrough for releasably securing one or more slats 510 of slat system 500. The installation and specific features of slat system 500 will be described in greater detail hereinbelow.

Continuing with reference to FIGS. 3-5, back section 210 is pivotably coupled to hip section 220 and is positioned adjacent to hip section 220 towards head end 101*a* (FIG. 2) of first frame 100 (FIG. 2). Back section 210 defines a generally rectangular, frame-like configuration that is dimensioned to support the upper body of a patient and includes first and second sides 211, 212, respectively, and first and second ends 213, 214, respectively. Similar to hip section 220, second end 214 of back section 210 includes a pair of spaced-apart female clevis members 218 secured thereto and extending therefrom. Female clevis member 218 are off-set relative to the first pair of female clevis members 227 of hip section 220 such that, upon positioning of back section 210 adjacent hip section 220, as best shown in FIG. 4, the pairs of female clevis members 218, 227 are disposed in end-to-end abutting relation relative to one another. In this position, a clevis pin 202 may be inserted through the each of the pairs of abutting female clevis members 218, 227 to pivotably secure back section 210 and hip section 220 to one another and, thus, to pivotably secure back section 210 relative to first frame, 100. Accordingly, back section 210 can be pivoted about clevis pins 202 relative to hip section 220 and first frame 100 (FIG. 2) between the substantially flat, or lying position and the raised, or seated position. As can be appreciated, these clevis pin 202 and female clevis member 218, 227 engagements allow for easy assembly and disassembly without requiring additional tools.

Similar to hip section 220, first and second sides 211, 212 of back section 210 each also include a shelf 219 extending inwardly therefrom. Shelves 219 each include a plurality of apertures 504, e.g., five (5) apertures 504, defined therethrough and spaced longitudinally therealong. As will be described in greater detail below, apertures 504 facilitate releasable securing of one or more slats 510 of slat system 500 to back section 110.

Back section 210 is also be configured to be both length and width adjustable. More specifically, back section 210 includes a pair of lateral extension portions 215, 216 that are telescopically engaged to back section 210 at opposes sides 211, 212, respectively, thereof. Lateral extension portions 215, 216 are selectively extendable relative to back section 210 to vary the width of back section 210. Back section 210 further includes an end extension portion 218 that is telescopically engaged to first end 213 of back section 210 and is selectively extendable relative thereto to vary the length of back section 210. As will be described hereinbelow, back section 210 and foot section 240 may be adjusted along the lengths thereof to adjust the overall length of second frame 200 between about 76 inches and about 86 inches, although other ranges are also contemplated, and/or such that either or both of back section 210 and foot section 240 may be independently length-adjusted.

Referring still to FIGS. 3-5, thigh section 230 of second frame 200 is pivotably coupled to hip section 220 and is positioned adjacent to hip section 220 towards foot end 101*b* (FIG. 2) of first frame 100 (FIG. 2). Thigh section 230 defines a generally rectangular, frame-like configuration that is dimensioned to support the thighs and upper legs of a patient and includes first and second sides 231, 232, respectively, and first and second ends 233, 234. respectively. Similar to back section 210 and hip section 220, first end 233 of thigh section 230 includes a pair of spaced-apart female clevis members 237 secured thereto and extending therefrom that are off-set relative to the second pair of female clevis members 228 of hip section 220 such that, upon positioning of thigh section 230 adjacent hip section 220, as best shown in FIG. 4, the pairs of female clevis members 237, 228 are disposed in end-to-end abutting relation relative to one another. In this position, similarly as described above a clevis pin 204 may be inserted through each of the abutting pairs of female clevis members 237, 228 to pivotably secure thigh section 230 and hip section 220 to one another to allow pivoting of thigh section 230 relative to hip section 220 and first frame 100 (FIG. 2) between a substantially straight position and a raised position. Second end 234 of thigh section 230 also includes a pair of female clevis members 238 extending therefrom for, as will be described below, pivotably engaging foot section 240 thereto to effect pivoting of foot section 240 upon the raising/lowering of thigh section 230.

Thigh section 230 further includes similar features as described above with respect to back section 210 and hip section 220 that will only be summarized here to avoid unnecessary repetition. More specifically, thigh section 230 includes a pair of shelves 239 having a plurality of apertures 506, e.g., two (2) apertures 506, defined therethrough for engaging one or more slats 510 thereto. Thigh section 230 further includes a pair Of telescoping lateral extension portion 235, 236 for selectively adjusting the width of thigh section 230.

With continued reference to FIGS. 2-5, foot section 240 of frame 200 is pivotably coupled to thigh section 230 towards foot end 101*b* (FIG. 2) of first frame 100 (FIG. 2). Foot section 240 defines a generally rectangular, frame-like configuration that is dimensioned to support the lower legs and feet of a patient. Foot section 240 is not directly coupled to first frame 100, but, rather, is both pivotable and moveable relative thereto, as will be described in greater detail hereinbelow. More specifically, foot section 240 includes first and second sides 241, 242, respectively, and first and second ends 243, 244, respectively. First end 243 of foot section 240 includes a pair of spaced-apart female clevis members 247 secured thereto and extending therefrom that are off-set relative to the second pair of female clevis members 238 of thigh section 230 such that, similarly as described above, foot section 240 may be pivotably secured to thigh section 230 via a pair of clevis pins 206 disposed through each set of the pairs of female clevis members 247, 238. Accordingly, foot section 240 is permitted to pivot about clevis pins 206 and relative to thigh section 230 between a substantially straight position and a downwardly-angled position.

Foot section 240 may further be configured to inhibit pivoting relative lo thigh section 230 beyond a pre-determined angle, such that foot section 240 remains disposed in an optimal position for supporting a patient's lower legs and feel regardless of the position of thigh section 230. This maximum pivoting may generally correspond to the position shown in FIG. 8, although other configurations are contemplated.

Foot section 240 further includes similar features as described above with respect to the other sections 210, 220, 230, and in particular, to back section 210. Accordingly, these features will only be summarized here to avoid unnecessary repetition. More specifically, foot section 240 is configured to be both length and width adjustable. A pair of lateral extension portions 245, 246 are telescopically engaged to foot section 240 at opposes sides 241, 242, respectively, thereof for selectively varying the width of foot section 240. Foot section 240 further includes an end extension portion 248 that is telescopically engaged to first end 243 thereof such that, in conjunction with back section 210, the overall length of second frame 200 may be adjusted and/or such that either or both of the back section 210 and foot section 240 may be independently length-adjusted. Foot section 240 also includes a pair of shelves 249 having a plurality of apertures 508, e.g., three (3) apertures 508, defined therethrough for engaging one or more slats 510 thereto.

Continuing with reference to FIGS. 2-5, and to FIGS. 4-5 in particular slat assembly 500 will be described. As discussed above, each section 210-240 of second frame 200 includes a pair of inwardly-extending shelves 219-249 that each include one or more apertures 502-508, respectively, defined therethrough. Slats 510 include corresponding apertures 512-518, respectively, that are configured to align with apertures 502-508 for insertion of a clevis pin (not explicitly shown) therethrough for securing slats 510 about each of the sections 210-240 of second frame 200. As can be appreciated, such a configuration allows for easy assembly and disassembly of sections 210-240, e.g., during shipping, and/or for the interchanging of slats 510 to permit usage of differently configured slats, without the need for tools. Further, as can be appreciated in view of the above, the easy engagement and disengagement of sections 210-240 to one another, e.g., using clevis pins 202-208, likewise facilitates assembly and disassembly for shipping and/or for interchanging the various components of second frame 200 without the need for tools. Additionally, each slat 510 may be independent of the other slats 510, or the slats 510 of each section 210-240 of second frame 200 may be secured to one another to define a slat group including a plurality of spaced-apart slats 510 configured according to the dimensions of the frame section 210-240 to which the slat group is to be secured. Alternatively, in non-removable embodiments, slats 510 may be fixedly engaged to respective sections 210-240 during manufacture.

Figure 6:
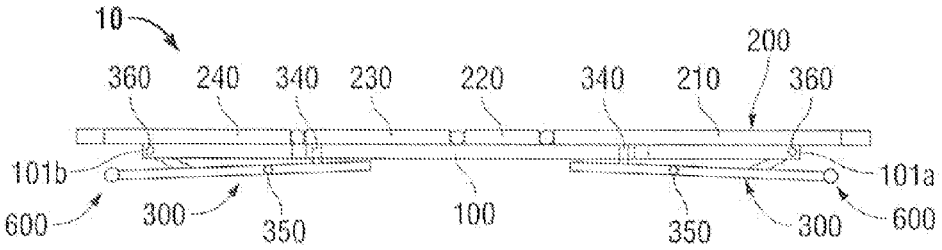
FIG. 6 is a side view of the adjustable bed of FIG. 1 shown in a lowered position.

Turning now to FIGS. 6-8, the operation of bed system 10 will be summarily described followed by a more detailed description of each of the assemblies that effect operation of bed system 10. As shown in FIG. 6, bed system 10 is disposed in a "low" position, wherein leg assemblies 300 are collapsed and wherein first and second frames 100, 200 are disposed in close proximity to the floor (not shown), or other surface supporting bed system 10. This "low" position may correspond to a distance, or height of about 7 inches between second frame 200 and the floor (not shown) or other supporting surface (not shown), although other configurations are contemplated.

As will be described in greater detail below, bed system 10 includes a first pair of independent actuators 420, 480 (FIG. 2) that are diagonally opposed relative to one another (see FIG. 2). Each actuator 420, 480 (FIG. 2) is configured to transition one of the leg assemblies 300 from the collapsed position, to a raised position, as shown in FIG. 7. This raised position corresponds to a "high" position of bed system 10, wherein second frame 200 is disposed at a height of about 31 inches relative to the floor (not shown) or other support surface (not shown), although other configurations are contemplated. Actuators 420, 480 may further be configured to cooperate with one another to position leg assemblies 300 and, thus bed system 10 in any number of pre-set positions, or in any position between the "low" and "high" positions to achieve a desired height of second frame 200. Further, due to the independence of actuators 420, 480, the leg assemblies 300 may each be raised (or lowered) to different heights, e.g., to achieve the Trendelenburg position and/or the reverse-Trendelenburg position.

FIG. 8 shows bed system 10 disposed in the "high" position and second frame 200 disposed in the seated and legs raised position. However, second frame 200 may be articulated from the substantially lying position (FIGS. 6-7) to the seated position, the legs raised position, or the seated and legs raised position (FIG. 8) regardless of the position of bed system 10, i.e., regardless of whether bed system 10 is disposed in the "low" position, "high" position, or any other position therebetween. More particularly, as will be described below, bed system 10 includes a second pair of independent and diagonally-opposed actuators 460. 440 (FIG. 2) that are configured to articulate, or pivot back section 210 and thigh section 230 (and, thus, foot section 240), respectively, relative to first frame 100. The opposed pairs of actuators 420, 480 and 440. 460 (FIG. 2), respectively, are disposed within first frame 100 and are arranged relative to one another to define a generally-rectangular configuration therein (see FIG. 2). As can be appreciated, actuators 460, 440 are independent of one another such that back section 210 may be articulated independently of thigh section 230. Further, the sections 210-240 may be width-adjusted and/or back and foot sections 210, 240, respectively, may be length-adjusted, as detailed above, at any articulated position or height position of bed system 10.

Figure 9:
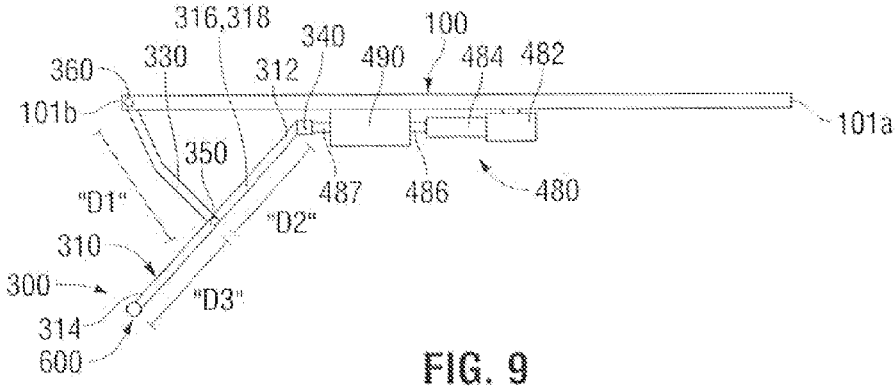
FIG. 9 is a schematic illustration showing height adjustment of a leg assembly of the adjustable bed of FIG. 1.

Turning now to FIG. 9, in conjunction with FIGS. 6-7, the operation of leg assemblies 300, in conjunction with actuators 420, 480 to raise, lower, and/or tilt (e.g., between the Trendelenburg and reverse-Trendelenburg position) bed system 10 is described. Each of the leg assemblies 300 and actuators 420, 480 are substantially similar to one another and, thus, reference will only be made to one of leg assemblies 300 configured for use with actuator 480 for purposes of brevity.

As shown in FIG. 9, actuator 480 is engaged to first frame 100 and depends therefrom. More specifically, actuator 480 includes a housing, or motor box 482 containing an electrical motor (not explicitly shown), or any other suitable motor as known in the art, and a sleeve 484 extend therefrom in generally parallel orientation relative to first frame 100. Sleeve 484 is configured to receive a telescoping actuator arm 486 therein that is reciprocatable therethrough between a retracted position and an extended position to extend and/or retract actuator 480 in a longitudinal direction. Actuator arm 486 is at least partially contained within an actuator brace 490 for inhibiting substantial movement and/or vibration of actuator 480 during use. Actuator arm 486 and actuator brace 490 will be described in greater detail below with reference to FIGS. 12-13.

Figure 14:
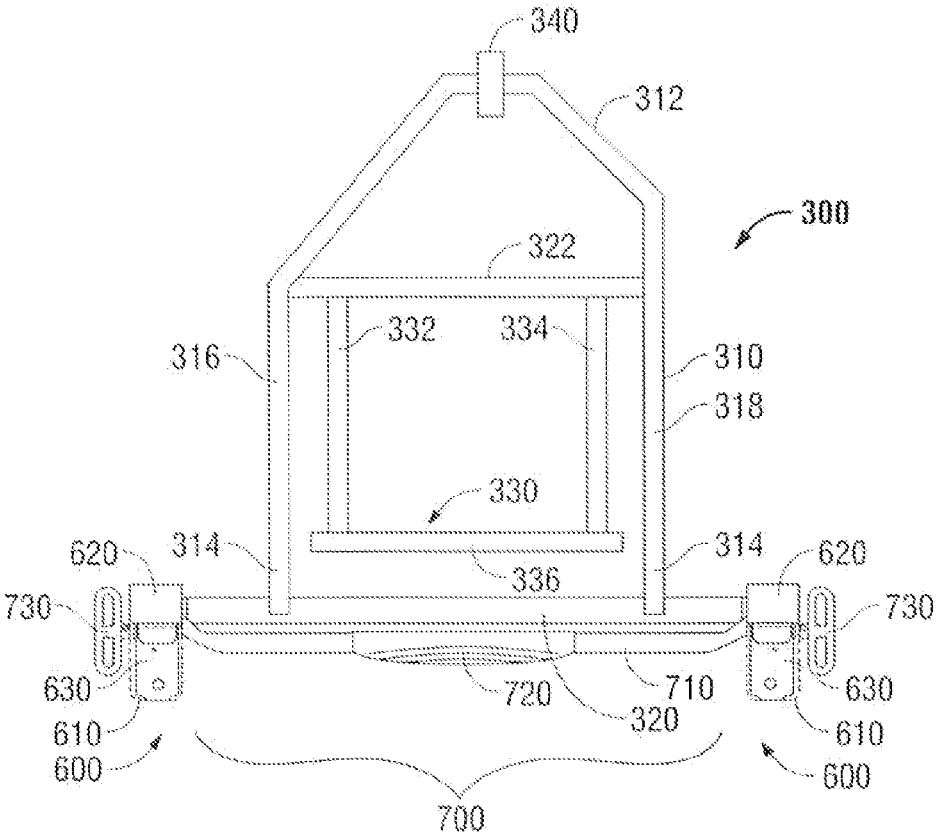
FIG. 14 is a top view of one of the leg assemblies of the adjustable bed of FIG. 1 shown including a easier assembly coupled thereto.

Continuing with reference to FIG. 9, in conjunction with FIG. 14, actuator arm 486 is pivotably coupled at free end 487 thereof to first end 312 of leg bracket 310 of leg assembly 300 via pivot point 340. Leg bracket 310, as best shown in FIG. 14, includes a pair of legs 316, 318 that meet at first end 312 of leg bracket 310 and extend downwardly and apart from one another to second end 314 thereof, wherein legs 316, 315 are spaced-apart from one another. A base bar 320 extends between legs 316, 318 at second end 314 thereof. Base bar 320 extends outwardly beyond each leg 316, 318 for securing caster assemblies 600 thereto, as will be described in greater, detail below. As can be appreciated, leg bracket 310 defines an asymmetrical configuration at first end 312 thereof, but a symmetrical configuration at second end 314 thereof such that leg assembly 300 is capable of stabily supporting first frame 100, while also being position to engage actuator 480 without interfering with the operation of the other actuators 420, 440, 460.

An intermediate bar 322 is fixed to and extends between legs 316, 318. Intermediate bar 322 is positioned between first and second ends 312, 314, respectively, of legs 316, 318 and is pivotably coupled to a support bracket 330 at pivot point 350. More specifically, first and second spaced-apart arms 332, 334 of support bracket 330 are pivotably coupled to intermediate bar 332 of leg bracket 310 and extend upwardly therefrom. Arms 332, 334, in turn, are joined at the other ends thereof to a crossbar 336 that is pivotably coupled to foot end 101*b* of first frame 100 at pivot point 360.

Put more generally, leg assembly 300 is pivotably and translatably coupled to actuator 480 at pivot point 340 and, thus is pivotably and moveably coupled first frame 100. Leg assembly 300 is also pivotably coupled to first frame 100 via support bracket 330 at pivot point 360. Support bracket 330, in turn, is pivotably coupled to leg bracket 310 about floating pivot point 350. As such, as will be described in greater detail below, extension or retraction of actuator 480 effects pivoting of leg assembly 300 about each of these three pivot points 340, 350, 360 to raise, lower, or tilt bed assembly 10. Additionally as shown in FIG. 9, the distances "D1," "D2," "D3" between pivot points 350 and 360, pivot points 340 and 360. and pivot point 360 and second end 314 of leg bracket 310, respectively, may be substantially equal to one another.

In use, as actuator arm 486 is extended from actuator 480, pivot point 340 is likewise translated away from actuator 480. As pivot point 340 is translated, leg bracket 310 is pivoted downwardly about pivot point 340, floating pivot 360 is translated in a generally downward direction, and support bracket 330 is pivoted about pivot pin 350. This movement causes leg bracket 310 to move toward a more up-right position, thus raising bed system 10 towards the position shown in FIGS. 7-9. On the other hand, when actuator 480 is operated to retract actuator arm 486, pivot point 340 is translated towards actuator 480, leg bracket 310 is pivoted upwardly and support bracket 330 is pivoted about pivot pin 350 such that leg bracket 310 is moved toward a more-parallel orientation relative to first frame 100, thereby lowering bed system 10 towards the position shown in FIG. 6.

Figure 10:
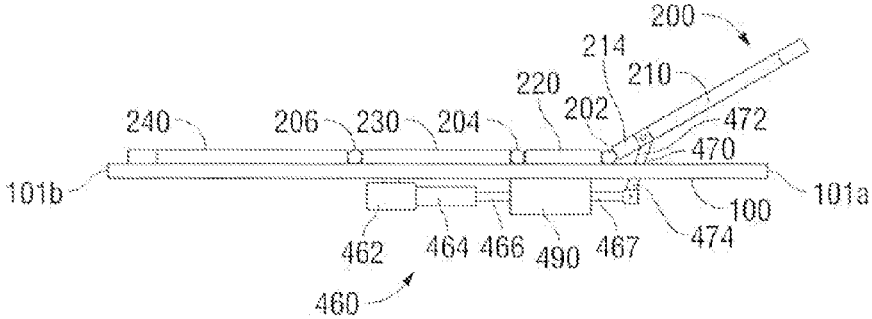
FIG. 10 is a schematic illustration showing articulation of a first section of the articulatable frame of the adjustable bed of FIG. 1.

With reference now to FIG. 10, the articulation of back section 210 of second frame 200 between the substantially lying position and the sealed position is described. As shown in FIG. 10; actuator 460 is engaged to first frame 100 and depends therefrom. More specifically, actuator 460 includes a housing, or motor box 462 containing an electrical motor (not explicitly shown) and a sleeve 464 extend therefrom in generally parallel orientation relative to first frame 100. Sleeve 464 receives telescoping actuator arm 466 therein. Actuator arm 466 is reciprocatable relative to sleeve 464 between a retracted position and an extended position to extend and/or retract actuator 460 in a longitudinal direction. Similar to actuator arm 486 (FIG. 9), actuator arm 466 is at least partially contained within an actuator brace 490 for inhibiting substantial movement and/or vibration of actuator 460 during use.

Continuing with reference to FIG. 10, a linkage 470 interconnects back section 210 of second frame 200 and actuator arm 466. More specifically, linkage 470 is pivotably coupled at first end 472 thereof to second end 214 of back section 210 and is pivotably coupled at second end 474 thereof to free end 467 of actuator arm 466.

In use, as can be appreciated, when actuator arm 466 is disposed in the retracted position, linkage 470 is disposed in generally parallel orientation relative to actuator arm 466 and first frame 100 such that back section 210 is disposed in the substantially lying position. As actuator arm 466 is extended toward the position shown in FIG. 10, actuator arm 466 is urged toward head end 101*a* of first frame 100, thereby urging linkage 470 to pivot upwardly which, in turn, urges back section 210 to pivot about clevis pins 202 from the substantially lying position to the raised back position. On the other hand, as actuator arm 466 is retracted, linkage 470 is pulled back towards the substantially parallel position such, that back section 210 is returned to the substantially lying position.

Figure 11:
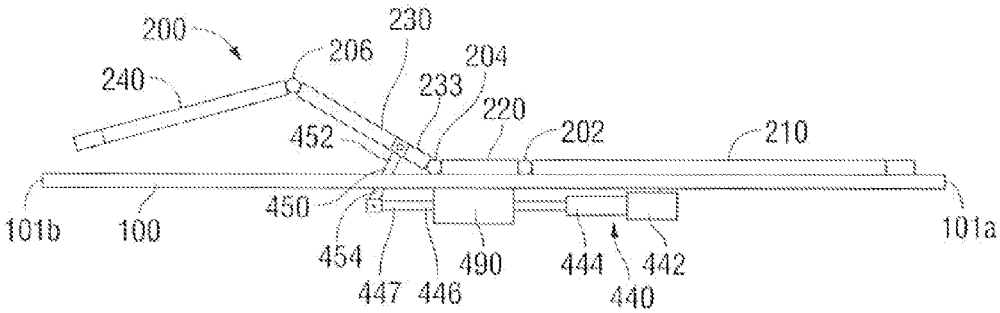
FIG. 11 is a schematic illustration showing articulation of third and fourth sections of the articulatable frame of the adjustable bed of FIG. 1.

With reference now to FIG. 11, the articulation of thigh and foot sections 230, 240, respectively, of second frame 200 between the substantially lying position and the legs raised position is described. As shown in FIG. 11, actuator 440 is engaged to first frame 100 and depends therefrom. More specifically, actuator 440 includes a housing, or motor box 442 containing an electrical motor (not explicitly shown) and a sleeve 444 extend therefrom in generally parallel orientation relative to first frame 100. Sleeve 444 receives telescoping actuator arm 446 therein, which is reciprocatable relative to sleeve 444 to extend and/or retract actuator 440 in a longitudinal direction. Actuator arm 446 is at least partially contained within an actuator brace 490, the importance of which will be described hereinbelow with reference to FIGS. 12-13.

Similar to the engagement between actuator 460 (FIG. 10) and back section 210, a linkage 450 is pivotably coupled at first end 452 thereof to first end 233 of thigh section 230 and is pivotably coupled at second end 454 thereof to free end 447 of actuator arm 446. As such, in use, when actuator arm 446 is disposed in the retracted position, linkage 450 is disposed in generally parallel orientation relative to actuator arm 446 and first frame 100 such that thigh section 230 and foot section 240 are disposed in the substantially lying position. As actuator arm 446 is extended toward the position shown in FIG. 11, actuator arm 446 is urged toward foot end 101*b* of first frame 100, thereby urging linkage 450 to pivot upwardly which, in turn, urges thigh section 230 to pivot about clevis pins 204 from the substantially lying position to the raised legs position. As thigh section 230 is pivoted upwardly, foot section 240, which is pivotably coupled thereto, is translated upwardly relative to first frame 100, while also being pivoted downwardly relative to thigh section 230 about clevis pins 206 to the position shown in FIG. 11. This position is desirable in that, in this legs raised position, the patient's knees are oriented above the rest of the legs, while the lower legs and feet are still supported by foot section 240.

To return to the substantially lying position, actuator arm 446 is retracted, thereby pulling linkage 450 is back towards the substantially parallel position such that thigh section 230 and foot section 240 are returned to the substantially lying position.

Figure 12:
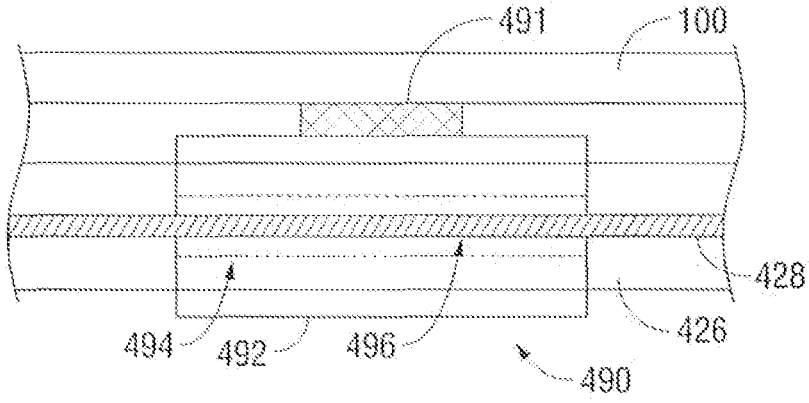
FIG. 12 is a longitudinal, cross-sectional view of an actuator brace configured for use with the adjustable bed of FIG. 1.
Figure 13:
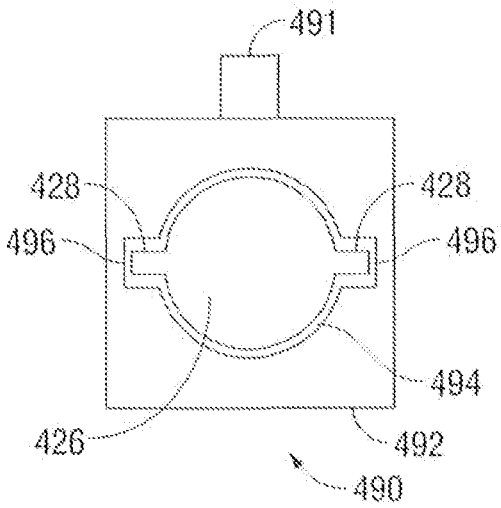
FIG. 13 is a transverse, cross-sectional view of the actuator brace of FIG. 12.

Referring now to FIGS. 12-13, actuator brace 490 is shown in use in conjunction with actuator 420. An actuator brace 490 is similarly used in conjunction with the each of the other actuators 440, 460, 480 (see FIGS. 9, 10 and 11, respectively), discussed above. However, to avoid unnecessary repetition, actuator brace 490 will be described with reference to actuator 420, keeping in mind that the other actuator braces 490 operate similarly with respect to the other actuators 440, 460,480 (see FIGS. 9, 10 and 11, respectively).

Actuator arm 426 of actuator 420 defines a generally cylindrically-shaped configuration, although other configurations are contemplated, e.g., square, or rectangular cross-sectional configurations, and is longitudinally reciprocatable along a longitudinal, or translation axis thereof between a retracted position and an extended position. Actuator brace 490 may be engaged directly to, e.g., welded to, first frame 100 (see FIGS. 9-11), or may be fixedly engaged thereto via a bracket 491. Actuator brace 490 includes an outer housing 492 having a lumen 494 extending longitudinally therethrough. Lumen 494 defines a cylindrically-shaped configuration (or any other suitable configuration) that is complementary to the configuration of actuator arm 426 to facilitate reciprocation of actuator arm 426 therethrough as actuator arm 426 is translated between the retracted and extended positions.

Actuator arm 426 further includes a pair of opposed, longitudinally-extending flanges 428 extending outwardly therefrom, although greater than two flanges 428 and/or differently positioned flanges 428 may also be provided. Flanges 428 are configured to be received within corresponding and complementary-shaped longitudinal recesses 496 defined within the inner surface of housing 292 formed by lumen 494. As can be appreciated, the engagement between flanges 428 and recesses 496 maintains actuator arm 426 in substantially fixed orientation relative to actuator brace 490 and, thus, first frame 100, thereby allowing for smooth, efficient, and consistent reciprocation of actuator arm 426 between the retracted and extended positions, while substantially eliminating vibrations and off-axis excursions of actuator arm 426 relative to the longitudinal, or translation axis thereof. In other words, actuator braces 490 guide the extension/retraction of actuators 420, 440, 460, 480 (FIG. 2) to ensure smooth, efficient, and consistent raising and lowering of leg assemblies 300 and articulation of second frame 200.

Figure 15:
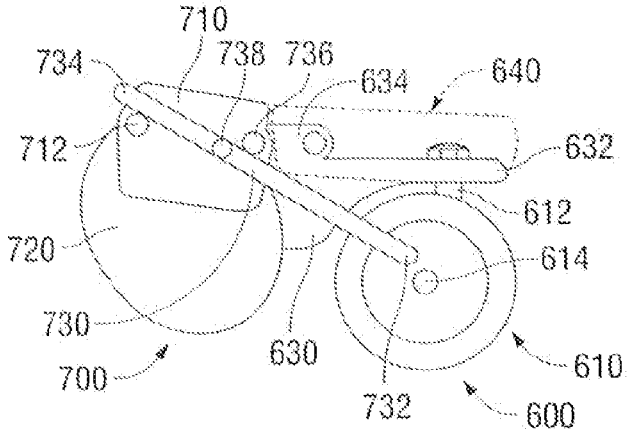
FIG. 15 is a side, cross-sectional view of the caster assembly of FIG. 14.

Turning to FIGS. 14-15, caster assemblies 600 and a locking mechanism 700 configured for use with caster assemblies 600 will be described, although it is envisioned that other suitable caster assemblies and/or locking mechanisms may be used in conjunction with bed system 10.

A pair of caster assemblies 600 are coupled to each leg assembly 300 at opposed ends of base bars 320 thereof to provide four caster assemblies 600 positioned adjacent the four corners of the generally rectangular-shaped bed system 10. As can be appreciated, this configuration provides a stable, balanced arrangement when bed system 10 is both stationary and while transporting a patient. Being that the caster assemblies 600 are substantially similar to one another, reference will be made to only one caster assembly 600 for purposes of brevity.

Caster assembly 600 generally includes a caster, or wheel 610 that is both rotatably mounted about a post 612 and pivotably mounted about a pivot pin 614 such that caster 600 may be oriented in any position through 360 degrees relative to leg assembly 300 and such that caster 610 can be rotated about pivot pin 614 to facilitate advancement of bed system 10 in that direction. Post 612 extends from caster 610 and is engaged to a plate 630, e.g., via bolt-aperture engagement. Plate 630 retains post 612 and, thus, caster 610 at a first end 632 thereof, and is fixedly secured to base bar 320 of leg assembly 300 at second end 634 thereof. Plate 630 may further include a removable cap 640 disposed thereof for protection the engagement between post 612 and plate 630. As can be appreciated, cap 640 can be removed such that caster 610 may be disengaged from plate 630 for replacement with a new and/or different caster.

With continued reference to *Figs*. 14-15, locking mechanism 700 is shown. Locking mechanism 700 may be coupled to the caster assemblies 600 disposed on the leg assembly 300 positioned toward the head end 101*a* (FIG. 2) of bed system 10 and/or the foot end 101*b* (FIG. 2) of bed system 10. Locking mechanism 700 generally includes a lock bar 710 pivotably coupled to second end 634 of plate 630 of each caster assembly 600 and extending. similar to base bar 320, between the caster assemblies 600 disposed at either end of leg bracket 310; a friction pad 720 disposed about lock bar 710 in a generally downwardly-facing orientation; and a pair of lock levers 730, each lock lever 730 fixedly engaged to lock bar 710 at either end thereof and pivotably coupled to the plate 630 of each caster assembly 600. More specifically, lock bar 710 is pivotably coupled to the plate 630 of each caster assembly 600 at pivot point 712 and is pivotable relative thereto between a raised, or unlocked position, wherein pad 720 is displaced from the floor (not shown), and a lowered, or locked position, wherein pad 720 is engaged with the floor (not shown) to frictionally retain bed system 10 in position.

Lock levers 730, which are disposed on each caster assembly 600 and extend outwardly therefrom, are operable to lock and unlock lock bar 710. Lock levers 730 are substantially similar to one another and, thus, only one lock lever 730 will be described herein. More particularly, lock lever 730 includes a first end 732, a second end 734, and a fixed connection point 736 where lock lever 730 is couple to lock bar 710. Lock lever 730 further includes a pivot point 738 wherein lock lever 730 is pivotably coupled to second end 634 of plate 630 of caster assembly 600. Fixed connection point 736 is offset relative to pivot pin 712 of lock bar 710, and is also offset relative to pivot point 738, i.e., fixed connection point 736 is disposed closer to first end 732 of lock lever 730, the importance of each of which will become apparent in view of the following.

In use the user may selectively step on the appropriate end 732, 734 of lock lever 730 for locking (or unlocking) lock bar 710. More specifically, in order to translate pad 720 into engagement with the floor to lock the position of bed system 10, the user steps down upon, or otherwise applies pressure to first end 732 of lock lever 730. This downward urging of First end 732 of lock lever 730, due to the offset positioning of fixed connection point 736 and pivot point 738 relative to one another, urges fixed connection point 736 downwardly. The downward urging of fixed connection point 736, in turn, causes lock bar 710 to pivot about pivot point 712 in a clockwise direction (in the orientation shown in FIG. 15) relative to caster assemblies 600 such that lock pad 720 is moved into engagement with the floor (not shown) to frictionally lock bed system 10 in position.

In order to unlock locking assembly 700, the user steps down upon, or otherwise applies pressure to second end 734 of lock lever 730. Pressuring second end 734 of lock lever 730, due to the offset positioning of fixed connection point 736 and pivot point 738 relative to one another, urges fixed connection point 736 upwardly and, thus, causes lock bar 710 to pivot about pivot pin 712 in a counterclockwise direction (in the orientation shown in FIG. 15) relative to caster assemblies 600 such that lock pad 720 is moved away from, i.e., is disengaged from, the floor (not shown) to unlock bed system 10.

The above description, disclosure, and figures should not be construed as limiting, but merely as exemplary of particular embodiments. It is to be understood, therefore, that the disclosure is not limited to the precise embodiments described, and that various other changes and modifications may be effected by one skilled in the art without departing from the scope or spirit of the present disclosure. Additionally, persons skilled in the art will appreciate that the features illustrated or described in connection with one embodiment may be combined with those of another, and that such modifications and variations are also intended to be included within the scope of the present disclosure. Therefore, the above description should not be construed as limiting, but merely as exemplifications of particular embodiments.

What is claimed is:

1. An adjustable bed system, comprising:

a first frame defining a head end and a foot end, the first frame being disposed within a plane;

a second frame disposed atop and coupled to the first frame, the second frame including a plurality of sections, a first section fixedly secured to the first frame and positioned between the head and foot ends thereof, a second section pivotably coupled to the first section and positioned towards the head end of the first frame, and a third section pivotably coupled to the first section and positioned towards the foot end of the first frame;

first and second leg assemblies, the first leg assembly disposed towards the head end of the first frame and the second leg assembly disposed towards the foot end of the first frame;

first and second actuator assemblies, wherein:

the first actuator assembly includes a first actuator and a first linkage, the first actuator coupled to the first frame and including a first arm and a first sleeve, the first arm telescopically translatable relative to the first sleeve along a first axis disposed in parallel orientation relative to the plane of the first frame, the first linkage coupled between the first arm and the second section of the second frame such that translation of the first arm relative to the first sleeve between a first retracted position and a first extended position for selectively pivoting the second section of the second frame relative to the first frame; and the second actuator assembly includes a second actuator and a second linkage, the second actuator coupled to the first frame and including a second arm and a second sleeve, the second arm telescopically translatable relative to the second sleeve along a second axis disposed in parallel orientation relative to the plane of the first frame, the second linkage coupled between the second arm and the third section of the second frame such that translation of the second arm relative to the second sleeve between a second retracted position and a second extended position for selectively pivoting the third section of the second frame relative to the first frame;

a first actuator brace fixedly engaged to the first frame and depending therefrom, the first actuator brace defining a first lumen extending longitudinally therethrough in parallel orientation relative to the plane of the first frame, the first arm of the first actuator slidably disposed within the first lumen of the first actuator brace; and a second actuator brace fixedly engaged to the first frame and depending therefrom, the second actuator brace defining a second lumen extending longitudinally therethrough in parallel orientation relative to the plane of the first frame, the second arm of the second actuator slidably disposed within the second lumen of the second actuator brace.

2. The adjustable bed system according to claim 1, wherein the first arm and the first lumen define complementary cross-sectional configurations to inhibit off-axis excursions of the first arm as the first arm is translated along the first axis, and wherein the second arm and the second lumen define complementary cross-sectional configurations to inhibit off-axis excursions of the second arm as the second arm is translated along the second axis.

3. The adjustable bed system according to claim 2, wherein the first and second arms each includes at least one flange extending therefrom, the at least one flanges configured for receipt within complementary-shaped recesses defined within inner surface of the respective first and second actuator braces.

4. The adjustable bed system according to claim 1, further comprising third and fourth actuators, wherein:

the third actuator is coupled to the first frame and including a third arm and a third sleeve, the third arm telescopically translatable relative to the third sleeve along a third axis disposed in parallel orientation relative to the plane of the first frame, the first leg assembly pivotably coupled to the third arm such that translation of the third arm relative to the third sleeve between a third retracted position and a third extended position pivots the first leg assembly relative to the first frame for selectively adjusting a height of the head end of the first frame; and the fourth actuator is coupled to the first frame and including a fourth arm and a fourth sleeve, the fourth arm telescopically translatable relative to the fourth sleeve along a fourth axis disposed in parallel orientation relative to the plane of the first frame, the second leg assembly pivotably coupled to the fourth arm such that translation of the fourth arm relative to the fourth sleeve between a fourth retracted position and a fourth extended position pivots the second leg assembly relative to the first frame for selectively adjusting a height of the foot end of the first frame.

5. The adjustable bed system according to claim 1, further comprising a fourth section of the second frame, the fourth section pivotably coupled to the third section at an opposite end of the third section relative to the coupling of the third section and the first section.

6. The adjustable bed system according to claim 1, wherein the sections of the second frame are releasably coupled to one another.

7. The adjustable bed system according to claim 1, wherein each section of the second frame includes a first longitudinal side and a second longitudinal side, at least one of the first and second longitudinal sides of each section of the second frame telescopically extendable to extend a width of the section.

8. The adjustable bed system according to claim 1, wherein each of the sections of the second frame includes a first end and a second end, at least one of the first and second ends of at least one section telescopically extendable to extend a length of the second frame.

9. The adjustable bed system according to claim 1, wherein each of the sections of the second frame includes at least one removable slat coupled thereto and extending between first and second sides thereof.

10. The adjustable bed system according to claim 1, wherein each leg assembly includes a pair of caster assemblies disposed at opposed sides thereof, the caster assemblies rotatable to facilitate translation of the adjustable bed system.

* * * * *